US009217230B2

(12) United States Patent
Wallace

(10) Patent No.: US 9,217,230 B2
(45) Date of Patent: Dec. 22, 2015

(54) BARRIER SYSTEM

(71) Applicant: Safe Direction Pty Ltd, Loftus, NSW (AU)

(72) Inventor: Hayden Wallace, Loftus (AU)

(73) Assignee: Safe Direction Pty Ltd, Loftus, NSW (AU)

( * ) Notice: Subject to any disclaimer, the term of this patent is extended or adjusted under 35 U.S.C. 154(b) by 0 days.

(21) Appl. No.: 14/596,842

(22) Filed: Jan. 14, 2015

(65) Prior Publication Data

US 2015/0129822 A1 May 14, 2015

Related U.S. Application Data

(63) Continuation-in-part of application No. 14/052,017, filed on Oct. 11, 2013, now Pat. No. 8,960,647.

(51) Int. Cl.
*E01F 15/04* (2006.01)

(52) U.S. Cl.
CPC ..... *E01F 15/0461* (2013.01); *E01F 15/0423* (2013.01)

(58) Field of Classification Search
CPC ..... E01F 15/00; E01F 15/04; E01F 15/0407; E01F 15/0423; E01F 15/0461; E01F 15/145; E01F 15/146; E01F 9/018; E01F 9/0182
See application file for complete search history.

(56) References Cited

U.S. PATENT DOCUMENTS

| | | | |
|---|---|---|---|
| 4,149,701 | A | 4/1979 | Densen |
| 7,794,173 | B2 | 9/2010 | Amengual Pericas |
| 2004/0262588 | A1 | 12/2004 | Bronstad |

FOREIGN PATENT DOCUMENTS

| | | | |
|---|---|---|---|
| AU | 2008261143 | A1 | 12/2008 |
| EP | 2180098 | A1 * | 4/2010 |
| EP | 2204495 | A2 * | 7/2010 |
| EP | 2628852 | A2 * | 8/2013 |
| FR | 2723602 | A1 | 8/1994 |

* cited by examiner

*Primary Examiner* — Daniel Wiley
(74) *Attorney, Agent, or Firm* — Kilpatrick Townsend & Stockton LLP

(57) ABSTRACT

A barrier system including a guardrail, a support to hold the guardrail in position and a fastener to attach the guardrail to the support, wherein the support has a weakened zone to facilitate the fastener releasing from the support when the support is subject to impact forces.

16 Claims, 13 Drawing Sheets

BARRIER SYSTEM

CROSS-REFERENCES TO RELATED APPLICATIONS

This application claims the benefit of and is a continuation-in-part of U.S. patent application Ser. No. 14/052,017 filed Oct. 11, 2013. The above-referenced application is hereby incorporated by reference herein in its entirety for all purposes.

FIELD OF THE INVENTION

The present invention relates to a barrier system particularly but not exclusively a road safety barrier system.

BACKGROUND OF THE INVENTION

Road safety barriers are designed to shield motorists from impacts with roadside hazards such as trees, utility poles, steep embankments, culverts and other vehicles. Road safety barriers are typically classified into three categories: rigid barriers; flexible barriers; and semi-rigid barriers.

Rigid barriers are generally employed where there is minimal margin for vehicles to move outside allocated traffic lanes. Such barriers may, for example, be formed of solid concrete. A disadvantage of concrete barriers is that vehicles that collide with the barriers could face severe impact damage.

Flexible barriers are employed where there is significant space beside the roadway to accommodate movement of a vehicle outside the traffic lanes. One such flexible barrier is formed of a series of tensioned cables.

Where there is lesser degree of available space adjacent a roadway, a semi-flexible barrier will generally be employed. One such barrier includes a series of upright posts along the roadside that support a guardrail. The guardrail serves as a containment ribbon under impact to absorb and re-direct a vehicle. During impact, the support posts may be knocked down and the guardrail needs to be maintained at a suitable height, to provide the required containment function, instead of being dragged down and under the vehicle as a result of continued attachment to the posts.

A number of mechanisms have been used in an attempt to maintain the height of the guardrail during impact. A first mechanism is to introduce a spacer block between the supporting posts and the guardrail. The spacer block rotates over the post as the post is knocked down to keep the guardrail elevated, until the guardrail physically disengages from the post. The spacer block minimized snagging of the vehicle on the post, due to the spacing between the guardrail and the posts, and reduces the potential for the vehicle to vault over the guardrail as the post height is maintained during the initial stages of impact. However, a problem with the spacer block arrangement is that the posts and spacer blocks are generally formed of open steel C-sections to minimize costs and both the posts and blocks tend to plastically crush and deform on impact instead of deflecting in order to separate from the guardrail. This ultimately has the effect of dragging the guardrail under the vehicle as a result of the vehicle fully impacting with the barrier.

Another mechanism to facilitate separation of the guardrail from the posts is to fix connecting collars to the guardrail. The collars are designed as sliding carriages that are arranged to slide over the posts and locate the guardrail at an appropriate height. When a vehicle impacts the barrier, the posts collapse and the collars freely slide off the ends of the posts. Once the collars are released, the guardrail becomes a substantially flexible ribbon that then demands a considerable distance be provided adjacent the roadway to arrest and redirect a vehicle.

Another mechanism is to attach the guardrail directly to the supporting posts by countersunk bolts that have a specific tapered head designed to pull through the guardrail under load. However, this mechanism has not been widely implemented since cheaper, non-tapered fasteners are readily available substitution may occur. If cheaper fasteners are installed, the guardrail will likely not function appropriately in the event of an impact. For safety reasons, this mechanism is not widely endorsed.

Any reference to known prior art does not, unless the contrary indication appears, constitute an admission that such prior art is commonly known by those skilled in the art to which the invention relates, at the date of this application.

OBJECT OF THE INVENTION

The present invention seeks to provide an improved or alternative barrier system.

SUMMARY OF THE INVENTION

In accordance with the present invention, there is provided a vehicle containment barrier system, comprising: a plurality of supports that each have a top end and a bottom end, wherein the supports are generally vertically orientated, and each include: a front side and rear side; a tab formed in the front side that is defined by reduced thickness area in the support comprising a recessed channel around the outer periphery of the tab, and a connection portion, wherein the connection portion is located at a bottom region of the tab and the reduced thickness areas is positioned at sides and a top region of the tab; a guardrail that is coupled to the supports so as to extend laterally across the front sides of the supports; and a plurality of connectors that couple the guardrail to the supports at the tabs, wherein the connectors are located within the outer periphery of the tabs; and wherein when a vehicle strikes the guardrail at the front side of the supports, the sides and top region of the tab move outwardly away from the support while the bottom region of the tab remains connected to the support and the tab remains connected to the guardrail, thereby suspending the guardrail above the ground while the supports move away from their generally vertical orientation as the vehicle impacts the barrier system.

In another aspect, there is provided a barrier system including a guardrail, a support to hold the guardrail in position and a fastener to attach the guardrail to the support, wherein the support has a weakened zone to facilitate the fastener releasing from the support when the support is subject to impact forces: wherein the weakened zone is arranged about a connection region of the support, though which the fastener is attached; and wherein the connection region is designed to remain attached to the fastener and guardrail and the support is adapted to separate along the weakened zone, under initial deflection of the support away from the guardrail, such that a tab of support material remains attached to the guardrail.

In another aspect, there is provided a barrier system with a guardrail for containing a vehicle impact including upright supports to suspend the guardrail above a ground surface and associated fasteners for connecting the guardrail to the supports, wherein the supports each include a weakened zone around a connection region where the fasteners are coupled to the respective supports, the weakened zone allowing the fasteners to release from the supports while remaining attached to the guardrail, when the supports move away from an upright orientation toward the ground surface when a vehicle impacts the barrier system.

Preferably, the weakened zone is arranged about a connection region of the support, though which the fastener is attached.

In another aspect, there is provided a support for use in the above system, the support having a weakened zone arranged about a connection region of the support, through which a fastener is attached to secure a guardrail to the support, the weakened zone facilitating release of the fastener from the support when the support is deflected away from the guardrail.

Preferably, the weakened zone is configured such that the tab is formed as an elongate vertical strip, and the separation propagates from an upper section of the support, toward a lower section of the support, as the support deflects away from the guardrail.

Preferably, the tab is designed to separate from the remainder of the support, upon further deflection of the support away from the guardrail.

Preferably, the weakened zone is in the form of a reduced thickness section of the support.

Preferably, the section includes a slot or perforation. More preferably, the section includes an array of slots or perforations.

Preferably, the weakened zone is square, rectangular, circular, C or U shaped.

Preferably, the weakened zone is continuously or intermittently spaced around the connection region.

Preferably, the support is in the form of a blocking piece attached to a post.

Alternatively, the support is in the form of a post. Preferably, the post has a square hollow section, rectangular hollow section, round hollow section, C section, U section, Z section, I post, H post or open hat cross section.

Preferably, the guardrail has a W-shaped cross section and a single fastener is used to connect the guardrail to the support. Alternatively, the guardrail has a triple crest section with a double trough, adapted to receive the fastener through one of the troughs. Preferably, a second fastener is fixed to the support through the second trough.

Preferably, the system includes a plurality of supports, with associated weakened zones, for attaching the guardrail.

BRIEF DESCRIPTION OF THE DRAWINGS

The invention is more fully described, with reference to the accompanying drawings, in which.

DETAILED DESCRIPTION OF THE INVENTION

Figure 1:
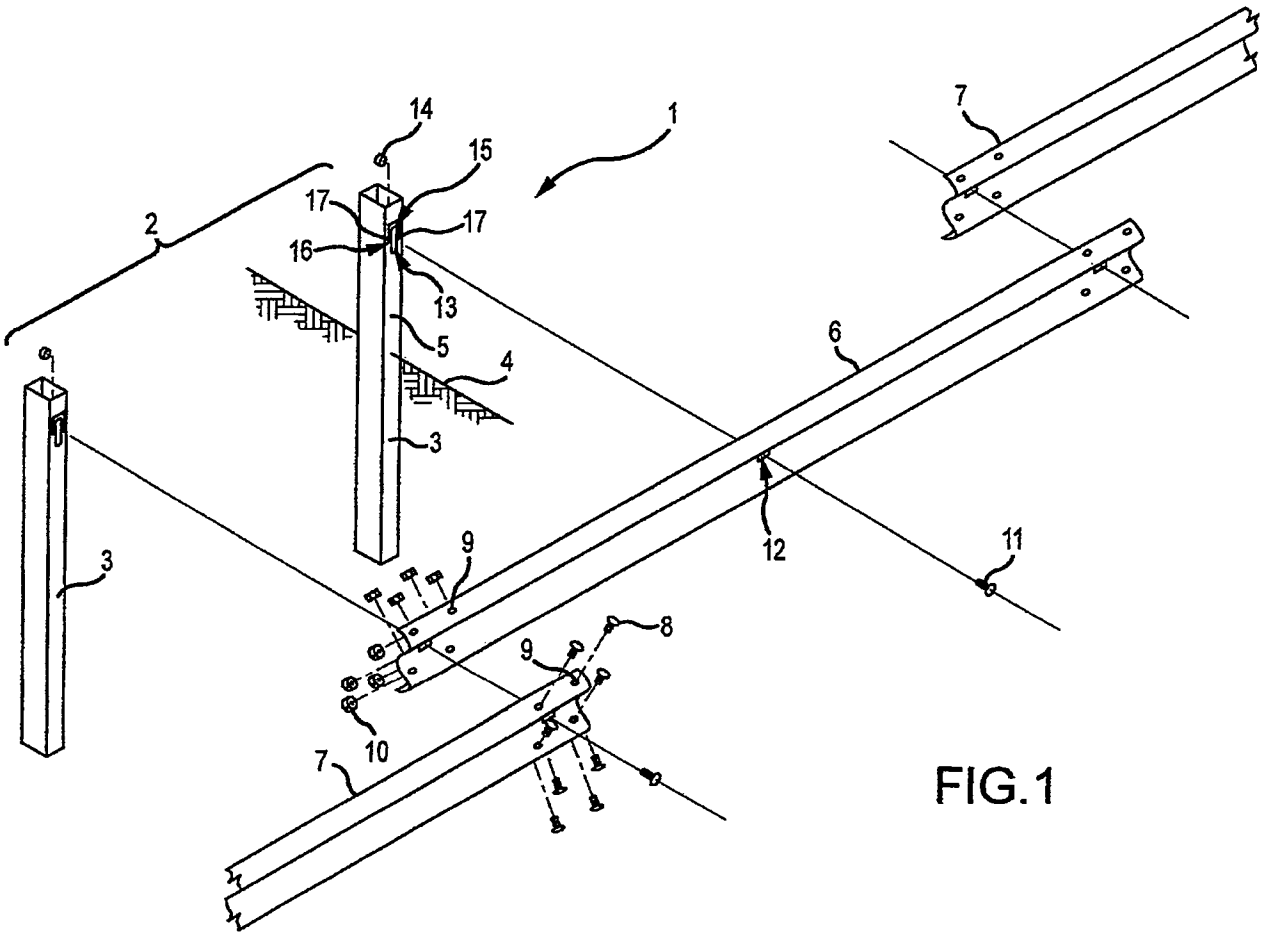
FIG. 1 is an exploded perspective view of a barrier system.

Throughout the following description, like reference numerals will be used to denote like parts.

Referring firstly to FIG. 1, a barrier system 1 is shown as including a series of supports 2 in the form of posts 3 fixed in a ground surface 4. Alternatively, each post could be mounted to a base plate that is bolted to a footing. Each post 3 has a front side 5, onto which is mounted a guardrail 6.

The guardrail 6 is formed as an elongate W-section. Adjacent guardrails 7 can be connected to the guardrail 6 by bolts 8 that pass through aligned openings 9 and are secured in place with nuts 10, so that the guardrails 6, 7 form a structurally continuous rail.

In order to mount the rail 6 to one of the posts 3, a connector or fastener 11 is provided though a hole 12 in the guardrail 6 and is fixed in a corresponding aperture 13 in the post 3 with a nut 14 that locks the fastener 11 in place. The hole 12 in the guardrail 6 has a horizontal dimension that accommodates some misalignment between the guardrail 6 and the aperture 13 in the post 3. Likewise, the aperture 13 has a vertical dimension that allows for a degree of vertical misalignment.

The aperture 13 is provided in a connection region 15 of the post 3 and a weakened zone 16, is arranged about the connection region 15. In this case, the weakened zone 16 is in the form of a vertical slot 17 arranged to either side of the aperture 13.

The function of the weakened zone 16 is to cause the post 3 to structurally fail or shear around the aperture 13, as the post 3 is deflected away from the guardrail 6, such as during a vehicle impact. The structural failure allows the fastener 11 and nut 14 to pull free from the post 3. This then allows the guardrail 6 to remain at a suitable height to function as a containment ribbon to absorb impact forces and redirect the vehicle. As such, a shear strength of the connection region 15 is designed, by way of the weakened zone 16, to be less than a connection force between the fastener 11 and the guardrail 6.

Figure 2:
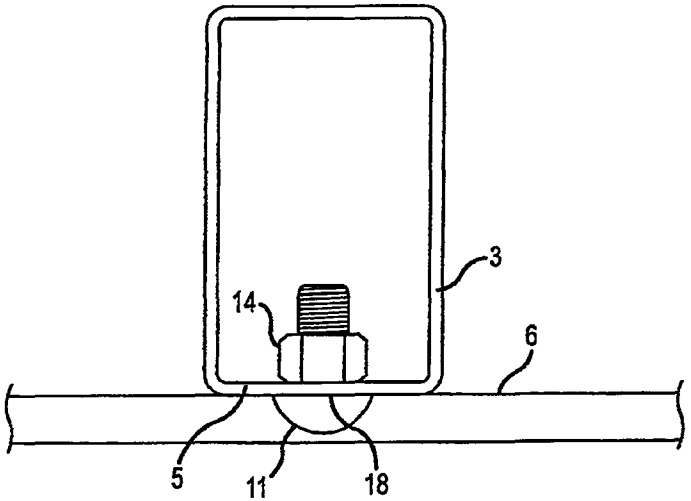
FIG. 2 is a plan view of a guardrail attached to a support.

Referring now to FIG. 2, a plan view is shown, which illustrates the connection between the post 3 and guardrail 6. The fastener 11 is more clearly shown as a mushroom head bolt 18 that is secured through the front face 5 of the post 3 and is fixed in place with the nut 14. The post 3 has a closed rectangular cross-section which is particularly strong and light weight, although other suitable forms of cross-section could instead be used, as required. For example, the cross-section could be formed with a square hollow section, round hollow section, C section, U section, Z section, I post, H post or open hat section.

Figure 3:
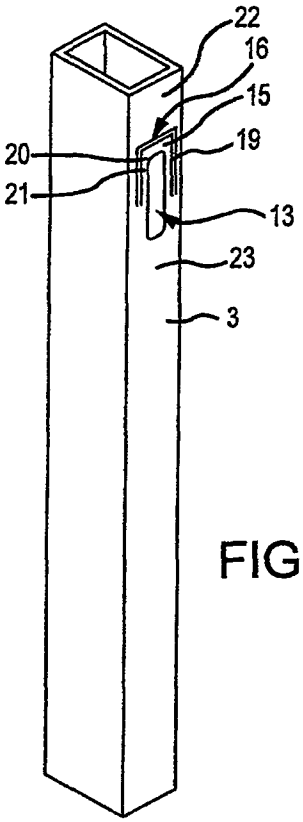
FIG. 3 is a perspective view of the support of FIG. 2.

Referring now to FIG. 3, the weakened zone 16 is in the form of a reduced thickness section of the post 3 and, more particularly, an inverted U-shaped slot 19. For the purpose of FIG. 3 and all subsequent Figures, where there are like parts shown in the drawings, like reference numerals will be used describe those like parts.

The slot 19 defines a tab 20 that includes the connection region 15 with the aperture 13. When the post is initially deflected, the connection region 13 remains attached to the fastener 11 and the guardrail 6 while the tab separates from the remainder of the post 6 along the weakened zone.

More particularly, the tab 20 is in the form of a vertical strip 21 that is adapted to lift clear of the front face 5. The separation between the tab 20 and the post 3 propagates from an upper section 22 of the post 3, toward a lower section 23, as the post 3 deflects downward.

The tab 20 is designed to shear away from the post 3, upon further deflection of the post 3.

Figure 5:
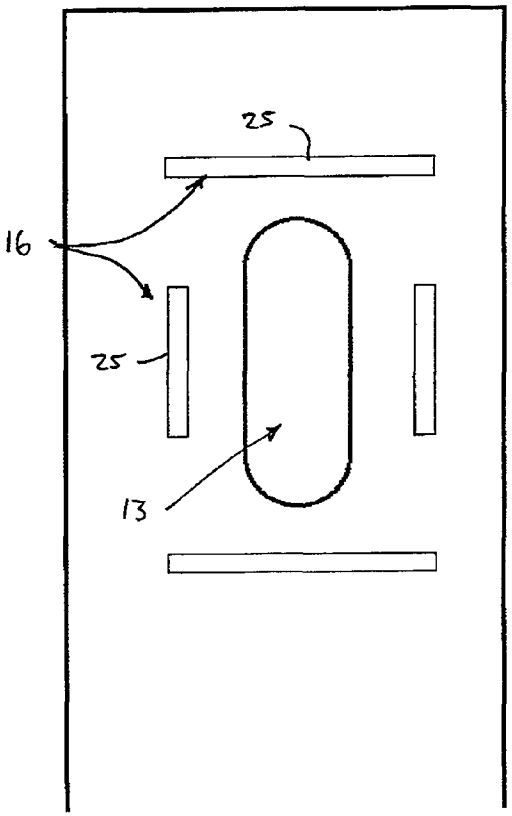
FIG. 5 is a front view of a different support with slots in a square array.
Figure 4:
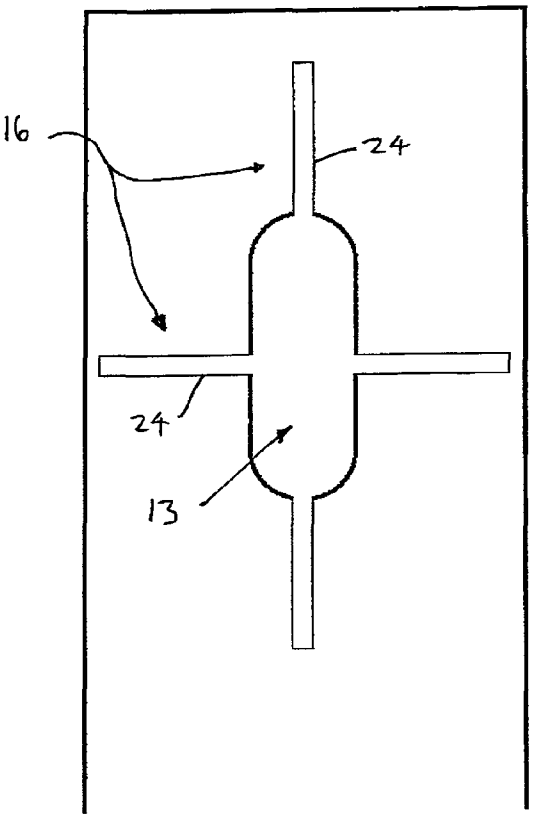
FIG. 4 is a front view of an alternative support with slots in a cross array.

FIGS. 4 and 5 show alternative examples of weakened zones 16, that are intended to facilitate release of the fastener 11 from the aperture 13, as opposed to the creation of a tab. In FIG. 4, the weakened zone 16 is in the form of slots 24 arranged in a cross configuration. In FIG. 5, the slots 25 are arranged in a square array around the connection region 15.

Figure 7:
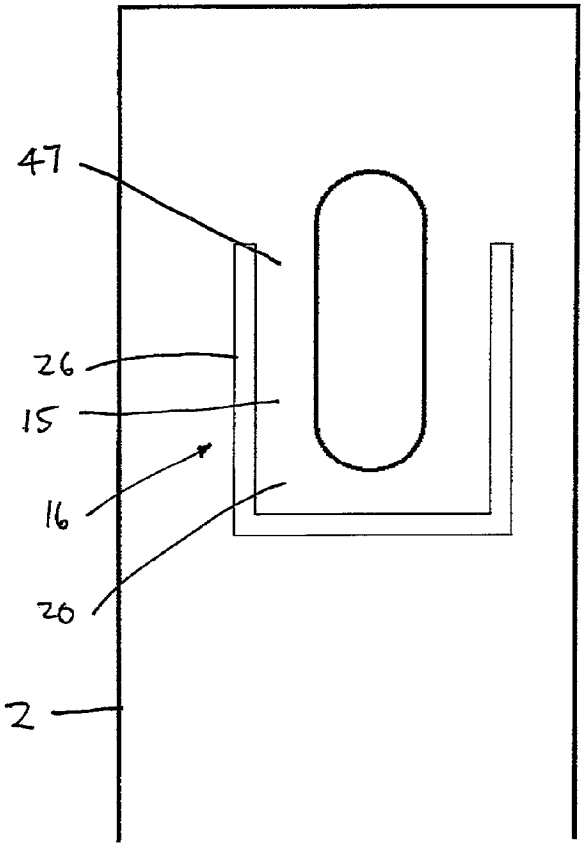
FIG. 7 is a front view of a further example of a support with a U-shaped slot.
Figure 6:
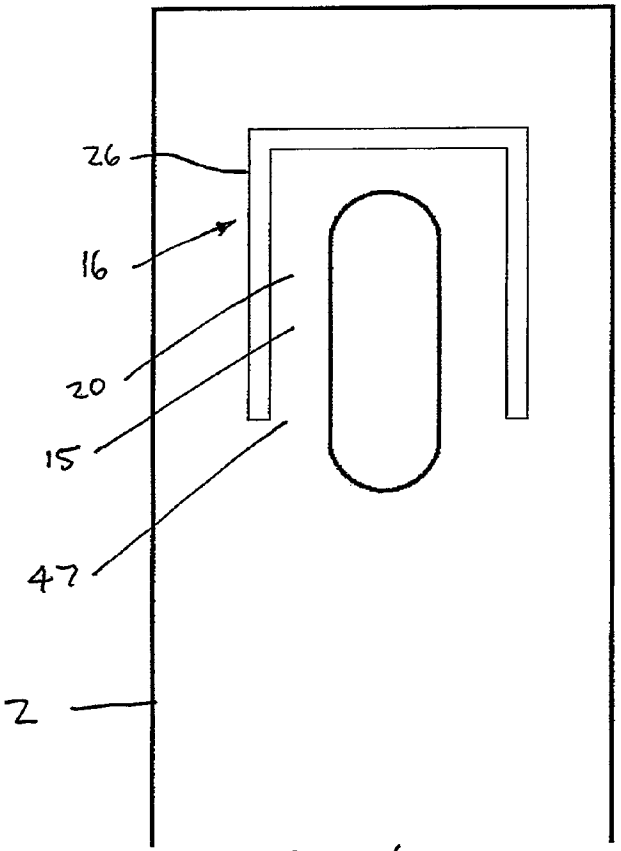
FIG. 6 is a front view of another example of a support with an inverted U-shaped slot.

FIGS. 6 and 7 illustrate further examples of the weakened zone 16 being in the form of a U-shape slot 26, with FIG. 6 showing an inverted U-shape. In both cases, the weakened zone 16 will result in the connection region 15 being in the form of a tab 20 that is attached to a main body 46 of the support 2 by way of a connection portion 47. In this case, a separation force shear strength of the connection portion 47 is configured to be less than a connection force between the fastener and guardrail (not shown) so that the tab deflects away from the body 46 under load and then separates from the support 2 as the support moves away from a vertical orientation and then collapses toward a ground surface.

Figure 9:
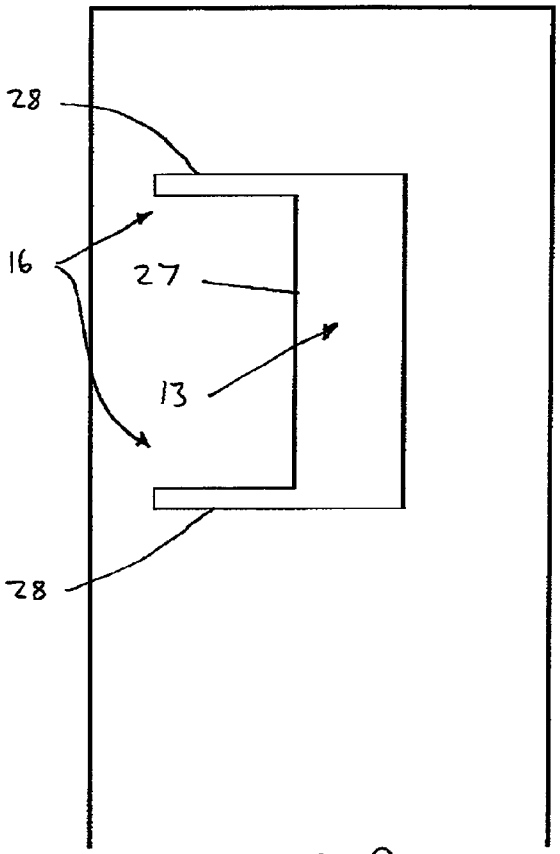
FIG. 9 is a front view of yet another example of a support with a D-shaped slot.
Figure 8:
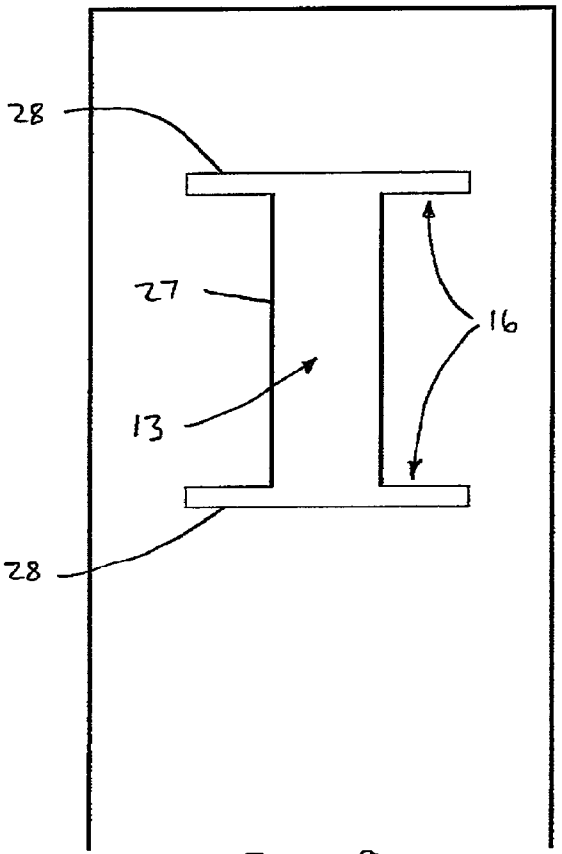
FIG. 8 is a front view of another support with an I-shaped slot.

FIGS. 8 and 9 show the aperture 13 as a rectangular slot 27 and the weakened zone 16 is then formed by horizontal slots 28 in communication with the aperture 13 whereby the overall zone 16 has an I-shape or D-shape, respectively.

Figure 11:
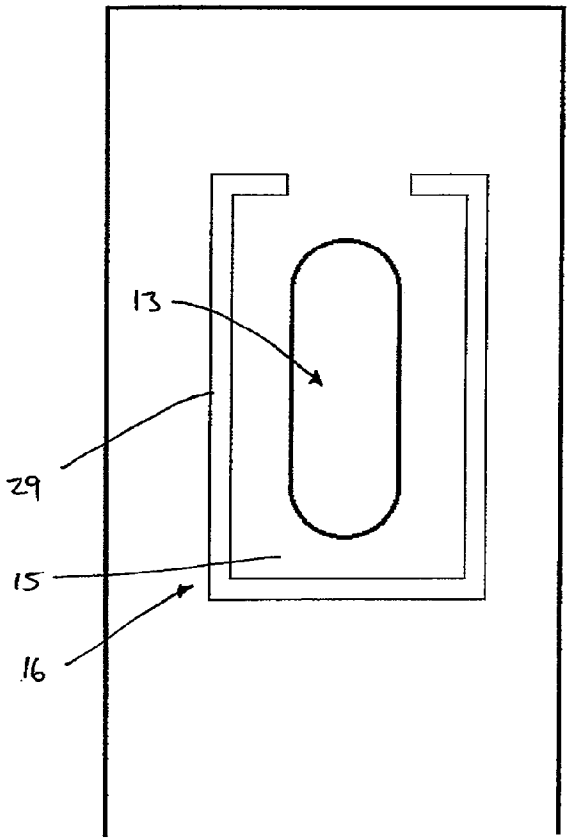
FIG. 11 is a front view of another support with a tab.
Figure 10:
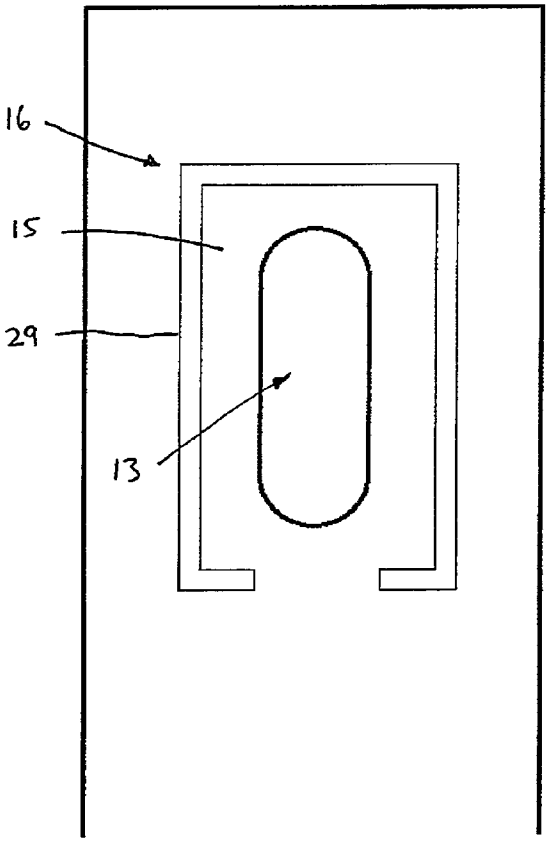
FIG. 10 is a front view of a support with a tab.

FIGS. 10 and 11 illustrate further examples of the weakened zone 16 being in the form of a continuous slot 29 around the connection region 15 and aperture 13 so as to define an associated tab 20.

Figure 13:
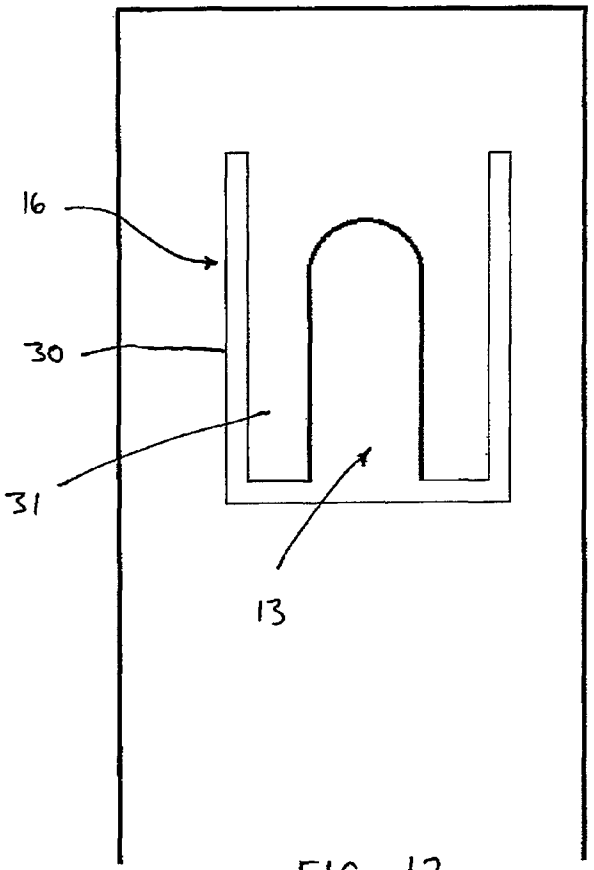
FIG. 13 is a front view of a further support with an inverted forked tab.
Figure 12:
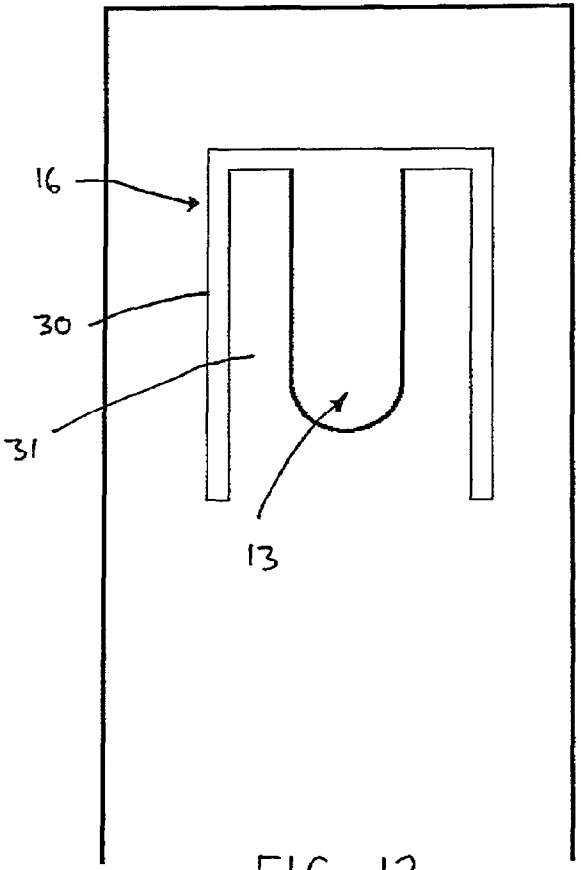
FIG. 12 is a front view of an alternative support with a forked tab.

Turning now to FIGS. 12 and 13, the weakened zone 16 is formed by U-shaped slots 30 that interconnect with the aperture 13 so as to define a fork-shaped tab 31.

Figure 15:
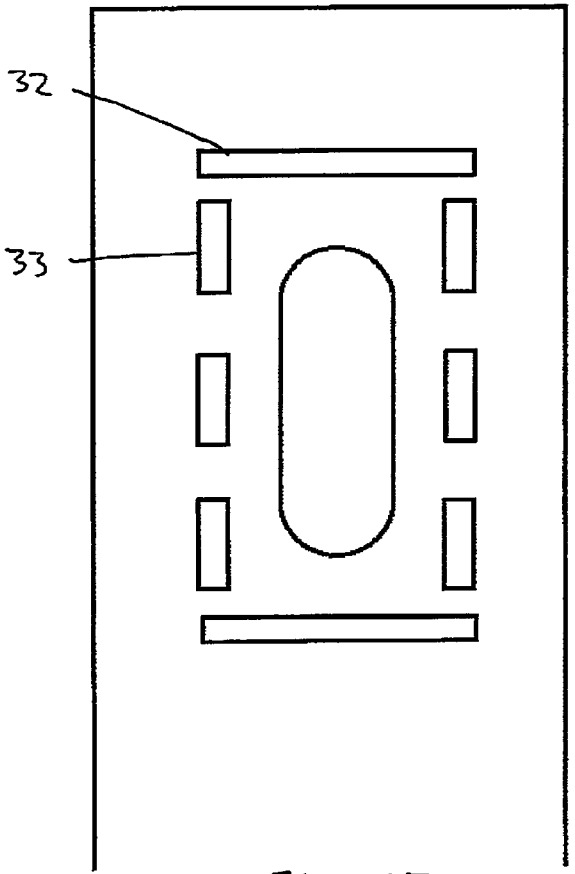
FIG. 15 is a front view of still another support with a square-shaped perforation.
Figure 14:
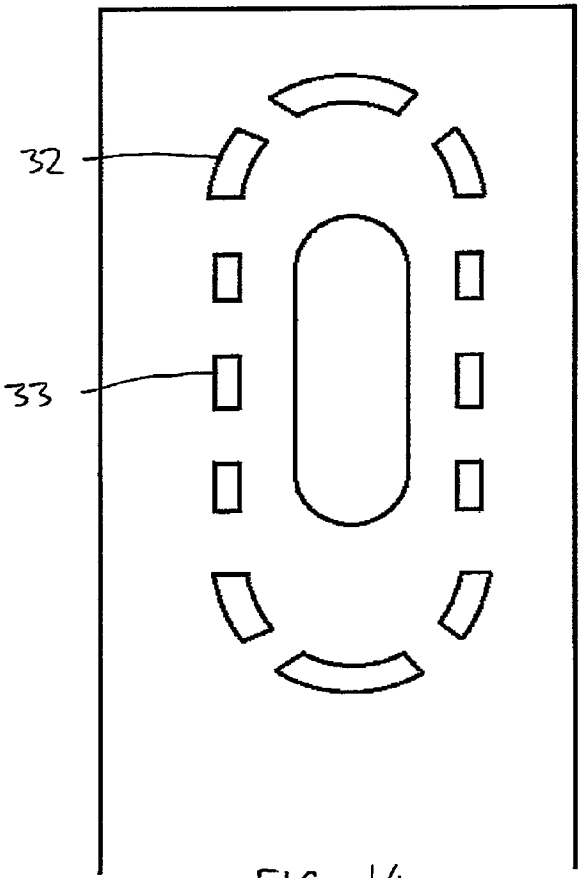
FIG. 14 is a front view of yet another support with an oval-shaped perforation.

In FIGS. 14 and 15, the slots 32 are formed intermittently and may in part be in the form of perforations 33. FIG. 14 illustrates the perforations 33 in an oval array while FIG. 15 shows a square array formed of a combination of slots 32 and perforations 33.

It should be appreciated that all of the slots or perforations described above embody a weakened zone 16 on the post 3. The perforations and slots can, of course be in any suitable array and need not in fact penetrate the thickness of the post. For example, the weakened zone 16 may be provided in the form of a reduced thickness zone of the post, as opposed to an actual slot or perforation.

Figure 16:
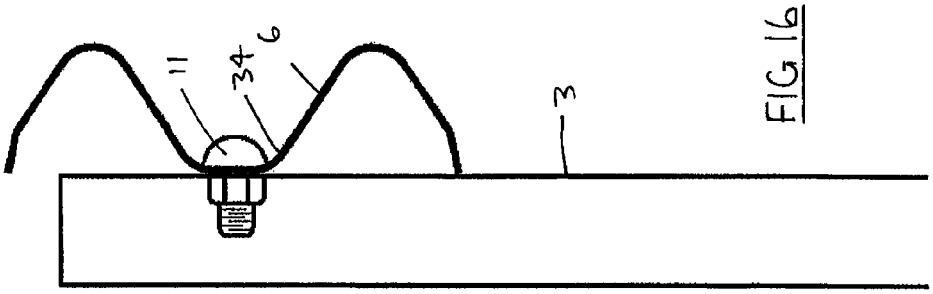
FIG. 16 is a side view of the guardrail fixed to a support.

Referring now to FIG. 16, a side view of the post 3 and guardrail 6 is shown. As described with reference to FIG. 1, the guardrail has a W-shaped cross section and only a single fastener 11 is used in trough 34 to secure the guardrail 6 to the post 3.

Figure 18:
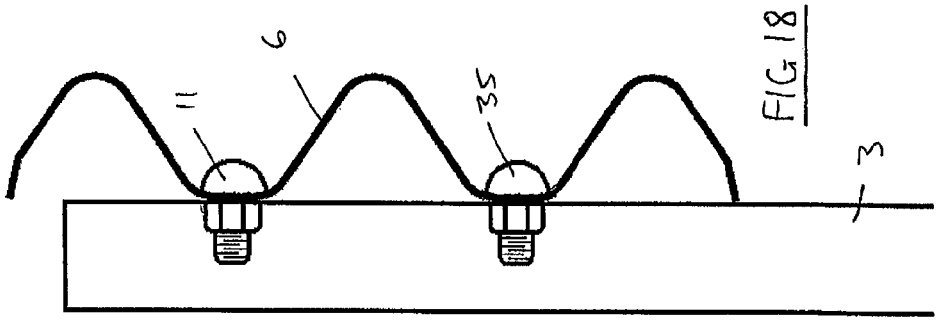
FIG. 18 is a side view of the guardrail of FIG. 17 attached to the post with two fasteners.
Figure 17:
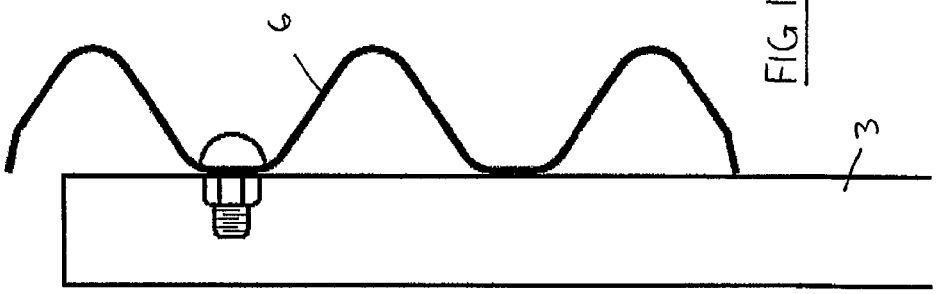
FIG. 17 is a side view of an alternative guardrail fixed to the support.

The guardrail 6 could, however, be of any suitable configuration and more than one fastener might be used. FIG. 17 illustrates a guardrail 6 with a triple-crest and a double trough, for increased stiffness, that can still be fastened to the post with a single fastener 11. FIG. 18 illustrates the guardrail attached to the post with a second fastener 35.

Figures 19, 20, 21:
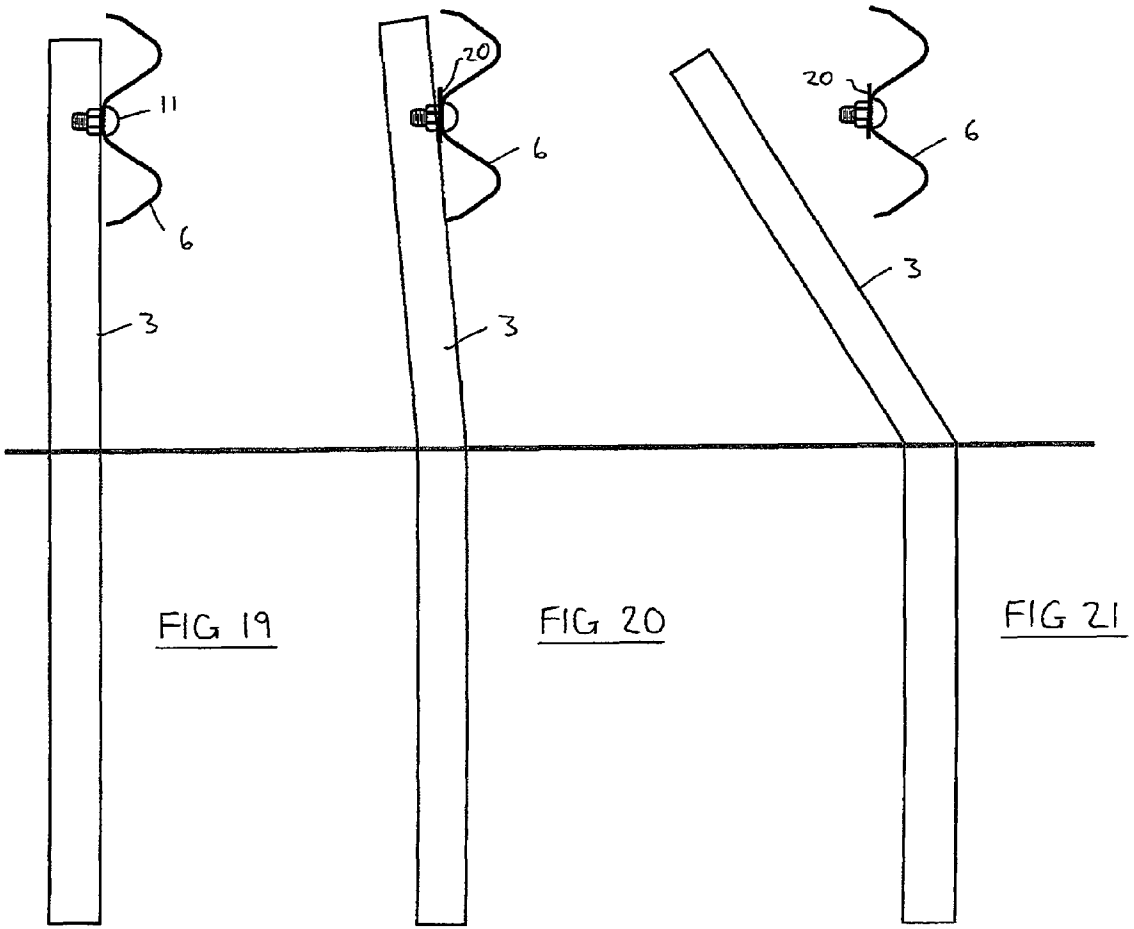
FIG. 19 is a side view of the post of FIG. 16 secured in the ground.
FIG. 20 is a side view of the post of FIG. 19 under partial deflection.
FIG. 21 is a side view of the post of FIG. 20 after further deflection.

Turning now to FIGS. 19 to 21, the operation of the barrier system 1 is described in more detail.

FIG. 19 shows the guardrail 6 fixed to a post 3 with a fastener 11, before impact of a vehicle. FIG. 20 shows initial deflection of the post 3 after impact of the vehicle. As can be seen, the post 3 is deflected downwardly while a tab 20 is separating from the post together with the connector or fastener 11.

FIG. 21 illustrates a condition in which the post 3 has deflected further under impact forces from the vehicle and that has resulted in the tab 20 tearing away from the main body 46 of the post 3, at the connection portion 47, so that the guardrail is able to remain elevated, in a suitable position to function as a containment ribbon to absorb and redirect the vehicle impact.

Figure 22:
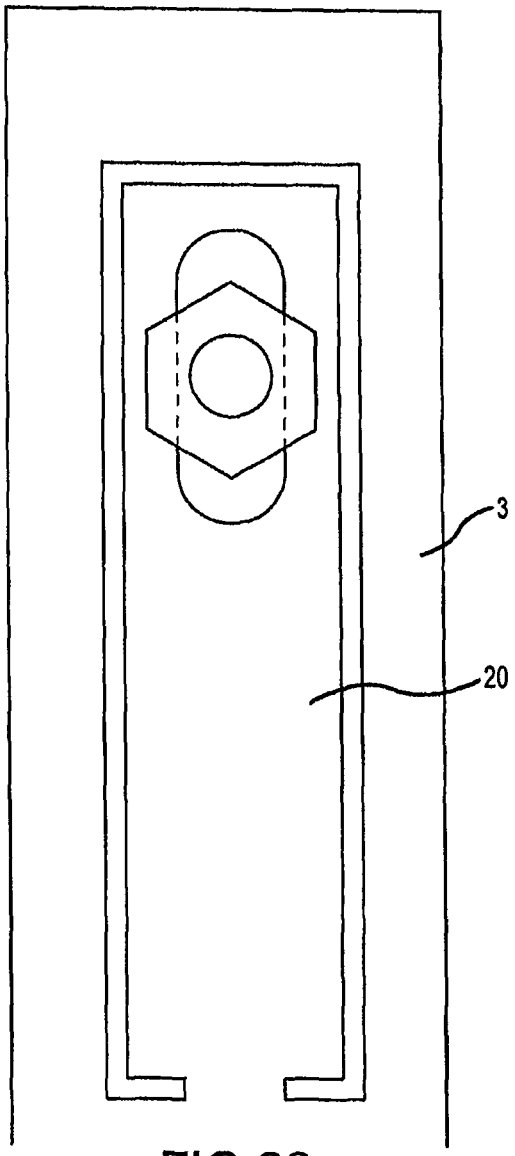
FIG. 22 is a front view of a different post showing another tab construction.

FIG. 22 shows a post 3 with a tab 20 that is considerably more elongate than that illustrated in FIGS. 19 to 21 but which otherwise functions in an identical manner.

Figures 23, 24, 25:
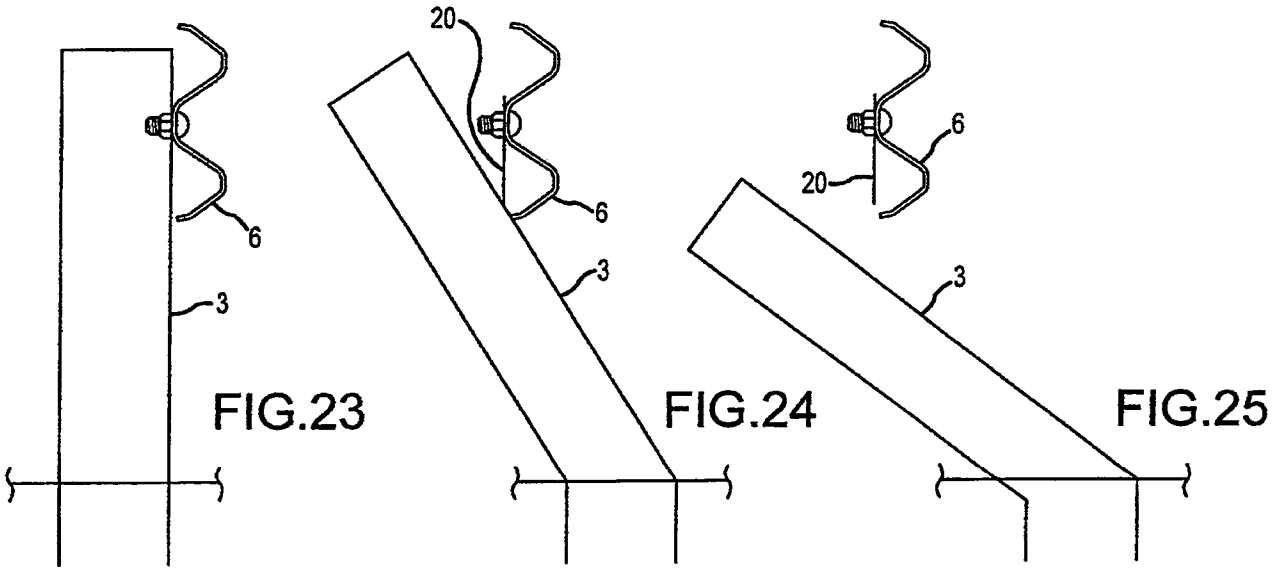
FIG. 23 is a side view of a guardrail fixed to a support.
FIG. 24 is a side view of the support of FIG. 23 under partial deflection.
FIG. 25 is a side view of the support of FIG. 24 after further deflection.

FIGS. 23 to 25 illustrate the elongate tab 20 in operation during a vehicle impact. The tab 20 also serves to separate from the post 3 when the post is fully deflected, however, the length of the tab 20 results in the guardrail 6 being attached to the post 3 for a longer period prior to separation, which can be advantageous if there is a need to utilize additional impact absorption via the post 3 to contain a vehicle impact, such as where there is limited available space adjacent the barrier system to allow for vehicle redirection. The longer tab also facilitates the rail remaining in a more vertical orientation until separation.

Figure 26:
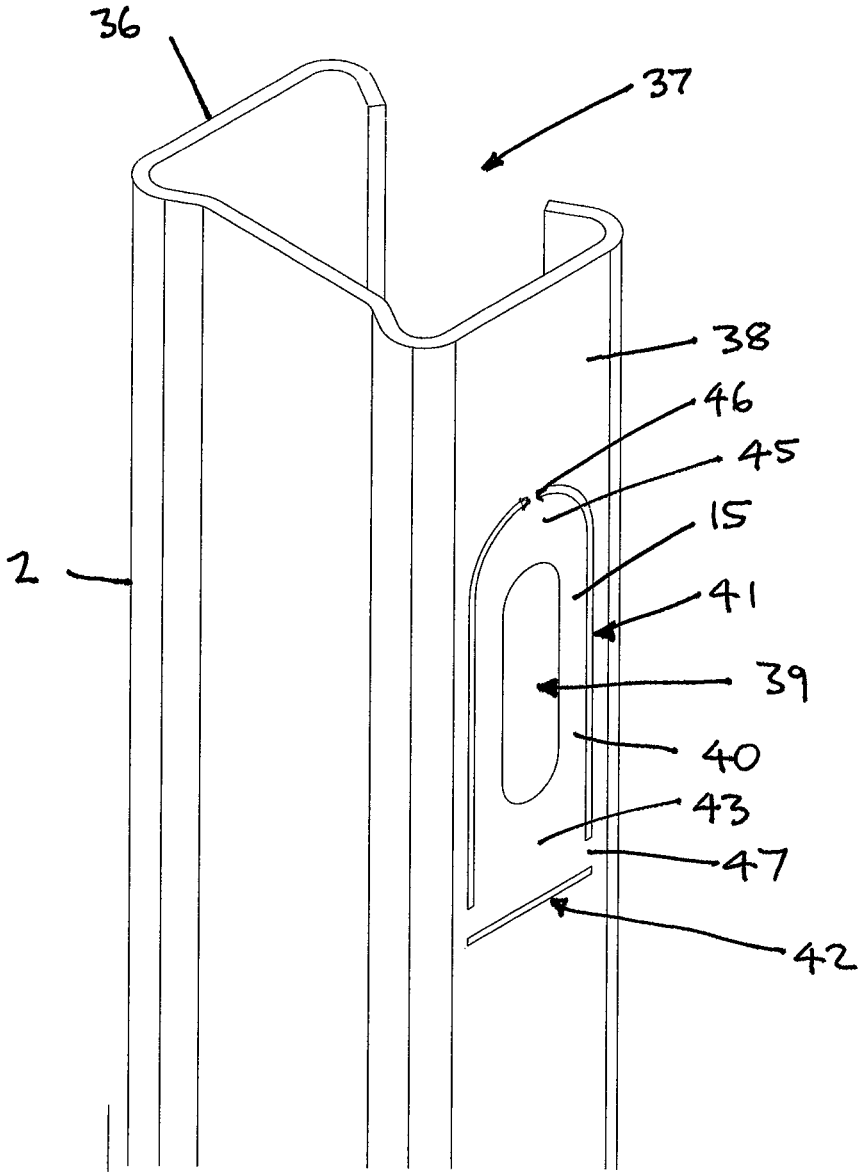
FIG. 26 is a partial perspective view of anther support.

FIG. 26 illustrates another support 2 in the form of a sigma post 36, which is named as a result of the cross-sectional profile resembling the Greek letter E. The post 36 has an open side 37 and a front side 38 with an aperture 39 designed to receive a fastener and nut (not shown). The aperture 39 is formed in a connection region 15 which is defined as a tab 40, between an arch-like slot 41 and a horizontally extending slot 42 at a base 43 of the tab 40. A connection portion 47 is located between the slots 41, 42. A small bridge 44 attaches a top end 45 of the tab 40 to a main body 46 of the post 36 to maintain the structural integrity and alignment of the tab 40 with respect to the body 46 such as during transport and installation of the post 36. The bridge 44 is designed to fail as soon as any significant load is applied to the tab 40, such as during impact of a vehicle, which will cause the tab 40 to separate from the body 46 as the post 36 moves away from a vertical orientation, toward a ground surface. The bridge 44 can, of course, be omitted if not needed.

The guardrail 6 has been described above primarily with reference to attachment to a post 3. However, it should be appreciated the guardrail 6 can instead be mounted to any support 2. Indeed, the support 2 could be in the form of a spacer piece that is itself attached to a post 3.

Also, the system 1 has been described specifically with reference to a road barrier system. However, the invention has application to any form of barrier system where containment and redirection of impact is required.

Regardless of the application, is it important for the guardrail 6 to disengage from the associated supports 2 in a controlled and relatively predictable manner so that the guardrail remains at a suitable height in order to function as a redirective ribbon.

The system has been described by way of non-limiting example only and many modifications and variations can be made thereto without departing from the spirit and scope of the invention described.

LIST OF PARTS

1. Barrier system
2. Support
3. Post
4. Ground surface
5. Side
6. Guardrail
7. Guardrail
8. Bolts
9. Openings
10. Nuts
11. Fastener
12. Hole
13. Aperture
14. Nut
15. Connection region
16. Weakened zone
17. Vertical slot
18. Bolt
19. Slot
20. Tab
21. Strip
22. Upper section
23. Lower section
24. Slots
25. Slots
26. Slot
27. U-shaped slot
28. Horizontal slots
29. Continuous slot
30. U-shapes slots
31. Fork-shaped tab
32. Slots
33. Perforations
34. Trough
35. Second fastener
36. Post
37. Open side
38. Front side
39. Aperture
40. Tab
41. Slot
42. Slot
43. Base
44. Bridge
45. End
46. Body
47. Connection portion

The invention claimed is:

1. A vehicle containment barrier system, comprising:

a plurality of supports that each have a top end and a bottom end, wherein the supports are generally vertically orientated, and each include:

a front side and rear side;

a tab formed in the front side that is defined by reduced thickness area in the support comprising a recessed channel around the outer periphery of the tab, and a connection portion, wherein the connection portion is located at a bottom region of the tab and the reduced thickness areas is positioned at sides and a top region of the tab;

a guardrail that is coupled to the supports so as to extend laterally across the front sides of the supports; and a plurality of connectors that couple the guardrails to the supports at the tabs, wherein the connectors are located within the outer periphery of the tabs; and wherein when a vehicle strikes the guardrail at the front side of the supports, the sides and top region of the tab move outwardly away from the support while the bottom region of the tab remains connected to the support and the tab remains connected to the guardrail, thereby suspending the guardrail above the ground while the supports move away from their generally vertical orientation as the vehicle impacts the barrier system.

2. The barrier system of claim 1, wherein a separation force shear strength of the connection portion is configured to be less than a connection force between the connector and tab so that the tab releases from the support, upon further defection of the support away from the guardrail, while the tab remains attached to the guardrail via the connector.

3. The barrier system of claim 1, wherein the tab is formed as an elongate vertical strip of the support and the reduced thickness area is provided so that separation of the tab propagates from an upper section of the support, toward a lower section of the support, as the support deflects away from the guardrail.

4. The barrier system of claim 3, wherein the reduced thickness area includes a slot or perforation.

5. The barrier system of claim 4, wherein the reduced thickness area includes an array of slots or perforations.

6. The barrier system of claim 3, wherein the reduced thickness area is square, rectangular, circular, C or U shaped.

7. The barrier system of claim 6, wherein the reduced thickness area is continuously or intermittently spaced around the connection portion.

8. The barrier system of claim 1, wherein each of the plurality of supports is in the form of a blocking piece attached to a post, which serves to space the guardrail from the post.

9. A barrier system including:

a guardrail, an upright support to hold the guardrail in position, the support including:

a tab formed in a front wall of the support, a fastener attaching a rear surface of the guardrail to the tab, and a weakened zone around the tab to facilitate the fastener and the tab releasing from the support when the support is subject to impact forces;

wherein the weakened zone is arranged about a connection region at a bottom of the tab; and wherein when an impact to the front of the support moves the support away from its upright position, the tab remains attached to the fastener and guardrail, and is adapted to separate from the front wall of the support along the weakened zone.

10. The barrier system of claim 9, wherein the weakened zone is configured such that the tab is formed as an elongate vertical strip, and the separation propagates from an upper section of the support, toward a lower section of the support, as the support deflects away from the guardrail.

11. The barrier system of claim 10, wherein the tab is designed to separate from the remainder of the support, upon further deflection of the support away from the guardrail.

12. The barrier system of claim 9, wherein the weakened zone is in the form of a reduced thickness section of the support.

13. The barrier system of claim 12, wherein the section includes a slot or perforation.

14. The barrier system of claim 9, wherein the support is in the form of a blocking piece attached to a post, which serves to space the guardrail from the post.

15. The barrier system of claim 9, wherein the system includes a plurality of supports, with associated weakened zones, for attaching the guardrail.

16. The barrier system of claim 9, wherein each tab includes an aperture, through which the respective fastener is mounted and secured in place with a nut, and wherein the weakened zone is formed of an array of perforations or slots, adjacent the aperture.

* * * * *